US011441585B2

(12) United States Patent
Buscicchio et al.

(10) Patent No.: US 11,441,585 B2
(45) Date of Patent: Sep. 13, 2022

(54) HYDRAULIC SYSTEM WITH ENERGY RECOVERY

(71) Applicant: Dana Motion Systems Italia S.R.L., Reggio Emilia (IT)

(72) Inventors: Luca Buscicchio, Modena (IT); Piergiorgio Trinchieri, Reggio Emilia (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 0 days.

(21) Appl. No.: 17/122,987

(22) Filed: Dec. 15, 2020

(65) Prior Publication Data

US 2021/0189694 A1 Jun. 24, 2021

(30) Foreign Application Priority Data

Dec. 20, 2019 (EP) ..... 19218472

(51) Int. Cl.
*F15B 21/14* (2006.01)
*E02F 9/22* (2006.01)

(52) U.S. Cl.
CPC ..... *F15B 21/14* (2013.01); *E02F 9/2296* (2013.01); *E02F 9/2217* (2013.01); *F15B 2211/20515* (2013.01); *F15B 2211/20569* (2013.01); *F15B 2211/428* (2013.01); *F15B 2211/6313* (2013.01); *F15B 2211/7052* (2013.01); *F15B 2211/761* (2013.01); *F15B 2211/88* (2013.01)

(58) Field of Classification Search
CPC ..... F15B 21/14; F15B 2211/20569; F15B 2211/20515; F15B 2211/6313; F15B 2211/761; F15B 2211/428; B66F 9/22
See application file for complete search history.

(56) References Cited

U.S. PATENT DOCUMENTS

| | | | | |
|---|---|---|---|---|
| 3,512,072 | A | 5/1970 | Karazija et al. | |
| 5,505,043 | A | 4/1996 | Baginski et al. | |
| 5,649,422 | A * | 7/1997 | Baginski | B66F 9/24 60/431 |
| 7,770,697 | B2 | 8/2010 | Futahashi et al. | |
| 9,469,515 | B2 * | 10/2016 | Matsuo | F15B 13/02 |
| 9,598,842 | B2 * | 3/2017 | Imura | E02F 9/2075 |
| 9,809,957 | B2 * | 11/2017 | Rosth | E02F 9/2296 |
| 9,932,993 | B2 * | 4/2018 | Zhang | F15B 1/04 |
| 10,066,368 | B2 | 9/2018 | Hijikata et al. | |

(Continued)

FOREIGN PATENT DOCUMENTS

| | | |
|---|---|---|
| DE | 4324464 A1 | 1/1995 |
| DE | 102014114526 A1 | 4/2016 |
| EP | 2058270 A1 | 5/2009 |

OTHER PUBLICATIONS

European Patent Office, Extended European Search Report Issued in Application No. 19218472.9, dated May 4, 2020, Germany, 8 pages.

*Primary Examiner* — Dustin T Nguyen
(74) *Attorney, Agent, or Firm* — McCoy Russell LLP

(57) ABSTRACT

A hydraulic system, comprising: a hydraulic pump, a hydraulic load, and an electric machine. The electric machine working as an electric generator and mechanically coupled with said hydraulic pump. A low-pressure fluid tank and a valve assembly comprising one or more valves selectively fluidly connecting the hydraulic load with the low-pressure fluid tank.

12 Claims, 3 Drawing Sheets

(56) References Cited

U.S. PATENT DOCUMENTS

| | | | | |
|---|---|---|---|---|
| 10,359,063 | B2 * | 7/2019 | Shan | B66C 13/12 |
| 2006/0185355 | A1 * | 8/2006 | Raszga | F15B 11/003 60/419 |
| 2007/0169473 | A1 * | 7/2007 | Esders | F15B 11/003 60/422 |
| 2008/0152513 | A1 * | 6/2008 | Esders | B66F 9/22 417/411 |
| 2010/0154399 | A1 * | 6/2010 | Bergstrom | E02F 9/2217 60/327 |
| 2013/0013159 | A1 * | 1/2013 | Moriki | H02P 21/06 701/50 |
| 2014/0260222 | A1 * | 9/2014 | Yahner | F15B 21/14 60/413 |
| 2019/0337775 | A1 * | 11/2019 | Shan | F15B 11/024 |

* cited by examiner

HYDRAULIC SYSTEM WITH ENERGY RECOVERY

CROSS-REFERENCE TO RELATED APPLICATION

The present application claims priority to European Patent Application No. 19 218 472.9, entitled "HYDRAULIC SYSTEM WITH ENERGY RECOVERY", and filed on Dec. 20, 2019. The entire contents of the above-listed application are hereby incorporated by reference for all purposes.

TECHNICAL FIELD

The present document relates to hydraulic systems and in particular to systems including an energy recovery system.

BACKGROUND AND SUMMARY

The presently proposed hydraulic system may be used with hydraulic lifters, compact stackers, or forklifts, for example. In particular, said hydraulic systems and devices may be run using stored electrical energy such as in the form of batteries.

It is well known from the prior art to run or power hydraulic systems using electrically stored energy. In these cases, an electric motor may be provided which is driven by energy delivered from a battery or a battery stack and which drives a hydraulic pump delivering high-pressure fluid. With the high-pressure fluid, one or more hydraulic devices in the hydraulic circuit may be driven.

It is also known from the prior art to use energy stored in the hydraulic circuit to drive an electric generator in order to recover energy, for example when a lifted load is being lowered.

For example, U.S. Pat. No. 7,770,697 discloses a system for recovering the potential energy generated by a hydraulic lift device for a forklift truck or the like in which a hydraulic pump for supplying pressurized working fluid to a lift cylinder to raise a load is used as a hydraulic motor by allowing the pressurized working fluid to return from the lift cylinder to the hydraulic pump when the load is lowered. An electric motor for driving the hydraulic pump is used as an electric generator to charge a battery in order to recover the potential energy of the load. A flow control valve is used to control the flow of working fluid form the load back to the hydraulic pump.

U.S. Ser. No. 10/066,368 is disclosing a hydraulic system with an energy recovery device including a hydraulic pump and a hydraulic cylinder for actuating a working assembly. A number of different hydraulic valves is controlled by an electric controller in order to optimize the flow of the hydraulic working fluid in the working phase as well as in the recovery phase.

From U.S. Pat. No. 5,505,043, a hydraulic system is known with an energy recovery device wherein the recovery device comprises a hydraulic pump which is driven by the working fluid flowing back from the load and which drives an electric generator. In order to control the back flow of the working fluid and to optimize energy recovery, a control unit for the electric generator comprises a separate field current controller including a desired value adjusting means determining the desired value of the field current based on predetermined relations between the speed and the current. This circuitry permits the operation of the DC machine through the full operational range as required by the hydraulic system for raising and lowering the load. Further, hydraulic switching and control means are not necessary for the control of energy recovery.

It is one goal of the current invention to provide a hydraulic system with an efficient energy recovery system. It is another goal of the current invention to provide a system which may be operated mostly using hydraulic control means. It is another goal of the current invention to reduce the number of control elements.

One or more of the goals mentioned above may be achieved by the hydraulic system described herein. Special embodiments are also described in the present disclosure.

The presently proposed hydraulic system comprises: a hydraulic pump/motor, a hydraulic load, an electric machine which is capable of working as an electric generator and which is mechanically coupled with said hydraulic pump/motor, a low-pressure fluid tank and a valve assembly comprising one or more valves selectively fluidly connecting the hydraulic load with the low-pressure fluid tank, wherein the valve assembly is configured such, that when the pressure at the hydraulic load is above a predetermined threshold pressure, for example above a first threshold pressure, the valve assembly fluidly connects the hydraulic load with the hydraulic pump/motor and fluidly disconnects the hydraulic load from the low-pressure fluid tank, and that when the pressure at the hydraulic load is below a predetermined threshold pressure, for example below a second threshold pressure equal to or lower than the first threshold pressure, the valve assembly fluidly disconnects the hydraulic load from the hydraulic pump/motor and fluidly connects the hydraulic load with the low-pressure fluid tank bypassing the hydraulic pump/motor.

The hydraulic pump/motor may be selectively used or operated as a hydraulic pump or as a hydraulic motor. The hydraulic pump/motor may be operated as a hydraulic pump configured to transform mechanical energy or pump drive torque into hydraulic energy, such as by pressurizing and/or conveying a hydraulic fluid. And/or the hydraulic pump/motor may be operated as a hydraulic motor configured to transform hydraulic or hydrostatic energy such as in the form of a pressurized fluid or fluid flow into mechanical energy and/or motor torque. For example, the hydraulic pump/motor may comprise an axial piston unit, a radial piston unit, a hydraulic gear unit, or the like.

The threshold pressure may be chosen at a value between the pressure that is generated by the hydraulic pump/motor in the working state and a minimum value of pressure that is generated by the load, e.g. if there is no external load and e.g. a fork lifter is lowered without an additional load.

In a working state, the electric machine may drive the hydraulic pump/motor to pressurize a hydraulic fluid or working fluid which may be delivered to the hydraulic load, for example through fluid channels, in particular a delivery channel. For example, the hydraulic pump/motor may be coupled to the electric machine which may act as an electric motor and which may drive the hydraulic pump/motor.

Additional means for driving the hydraulic pump/motor may be provided, for example, a hydraulic storage. The electric motor may be an AC motor, for example a brushless AC motor driven by a converter unit, which may also be used as an electric generator when driven by the hydraulic pump/motor. If the motor is implemented as an AC motor, a central converter and control unit may be used to drive two or more AC motors of the system, for example in case the hydraulic system is a mobile electric fork lifter. In this case, the fork lifter may comprise an electric AC drive for translational movement on the ground, and an AC motor for driving the hydraulic pump/motor of the hydraulic lifting system.

The AC motor which may be provided for driving the mobile fork lifter on the ground may comprise an electric energy recovery system. For instance, the AC motor may recover energy in a breaking phase of the fork lifter when moving on the ground. Consequently, a common stack of batteries which may feed both AC motors mentioned above through a converter unit may be reloaded by recovered electric energy from both AC motors.

In the hydraulic system, the pressurized work fluid may be used at a load in order to move a working piston and lift a weight. When the weight is lowered, or generally in a relief phase of the load, when no more pressurized fluid is transported to the load, the potential energy stored in or relieved via the hydraulic load may deliver a pressurized flow of hydraulic work fluid which can be directed through the hydraulic pump/motor in order to drive the electric motor/generator. In this case, a fluid channel that is different or partially different from the delivery channel may be used for directing the hydraulic fluid from the load to the hydraulic pump/motor. In this phase, the hydraulic pump/motor is typically not driven by the electric machine/motor. If or when a weight supported or held by the hydraulic load is large is enough, for example if or when the weight exceeds a threshold weight, the pressure of the working fluid generated by the weight at the load may be large enough to drive the hydraulic pump/motor, for example with a predetermined minimum speed or at a predetermined minimum power. If, however, the weight is not sufficiently large or the fork, in the example of a fork lifter, shall be lowered without a load, the pressure generated by the load may not be sufficient to drive the hydraulic pump/motor such as at a predetermined minimum speed or at a predetermined minimum power. For instance, a flow resistance of the hydraulic pump/motor may prevent the hydraulic pump/motor from being driven at the predetermined minimum speed or power. For this case, the presently proposed hydraulic system provides an additional way for the hydraulic work fluid to flow from the load to a low-pressure fluid tank without passing through or driving the hydraulic pump/motor. When releasing hydraulic or hydrostatic energy from or via the hydraulic load, fluid flow may be managed and/or controlled by means of hydraulic valves of the valve assembly.

In case a sufficiently high load is relieved, the hydraulic energy may be converted to electric energy. This electric energy may then be recovered in an energy storage device such as in battery.

In an embodiment the hydraulic system may comprise a hydraulic pump/motor configured to pressurize a hydraulic fluid, said hydraulic pump/motor being fluidly connected with a hydraulic load. The hydraulic load may be configured to store and/or release hydraulic or hydrostatic energy to pressurize the hydraulic fluid. Said hydraulic pump/motor may be mechanically coupled with an electric machine configured to work as a generator. The hydraulic load may be fluidly connected with a low pressure fluid tank through a valve assembly. The valve assembly may comprise a first and a second valve subassembly. The first valve subassembly may be switchable between a first state which is a working state and a second state which is a relief state. The first valve subassembly may be fluidly connected with the low pressure fluid tank through the second valve subassembly. A first exit channel or outlet port of the second valve assembly may be fluidly connected with the low pressure fluid tank through a first relief channel and a second exit channel or outlet port of the second valve subassembly may be fluidly connected with the low pressure fluid tank through a second relief channel. The first relief channel may pass through the hydraulic pump/motor in way that allows the hydraulic fluid to drive the pump/motor and the electric machine. The second relief channel may bypass the hydraulic pump/motor. The second valve subassembly may be controlled by the hydraulic pressure at the load such as to open the first exit channel or first outlet port and close the second exit channel or second outlet port if or when the hydraulic pressure at the load is higher than a threshold value, and to close the first exit channel or the first outlet port and to open the second exit channel or the second outlet port if or when the hydraulic pressure at the load is lower than the threshold value.

Another implementation of the hydraulic system described herein comprises a valve assembly with a first and second valve subassembly. The first valve subassembly in its first state, the working state, fluidly connects the hydraulic pump/motor, when it is driven by an electric motor, with the hydraulic load and allows hydraulic fluid to flow from the hydraulic pump/motor to the hydraulic load, for example for actuating a hydraulic device or implement. In its second state, the relief state, the first valve subassembly allows the hydraulic fluid to flow from the hydraulic load to the second valve subassembly.

The first valve subassembly may be actuated for example electrically or hydraulically or mechanically by a switch. The control of the first valve subassembly may be combined with the control of the hydraulic pump/motor.

The second valve subassembly may be fluidly connected with the low-pressure fluid tank through a first and second relief channel, and the second valve subassembly may be configured such that its state depends on the pressure level on its load side, i.e. on the side of the second valve subassembly that is next to or connected to the first valve subassembly. The second valve subassembly may be configured to selectively guide the hydraulic fluid from the hydraulic load to the low-pressure fluid tank either through the first relief channel or through the second relief channel. If or when the pressure on the load side of the second valve subassembly is higher than a threshold pressure value, for example higher than a first threshold value, the hydraulic fluid is relieved through the first relief channel and through the hydraulic pump/motor to the low-pressure fluid tank. And if or when the pressure on the load side of the second valve subassembly is lower than a threshold value, for example lower than a second threshold value equal to or lower than the first threshold value, the fluid is relieved through the second relief channel to the low-pressure fluid tank, bypassing the hydraulic pump/motor. This way, if or when the pressure on the load side of the valve assembly is high enough to drive the hydraulic pump/motor, for example at least at a predetermined minimum speed or at least at a predetermined minimum power, and to generate electric energy, the hydraulic fluid is led or guided through the hydraulic pump/motor. For example, the threshold pressure, or for that matter each of the first and the second threshold value, may be fixed at a value that is higher than 30%, 40%, 50%, 60%, 70% or 80% of the maximum pressure that is generated by the hydraulic pump/motor at the load.

In case of a low-pressure on the load side of the second valve subassembly or on the load side (that is, the side of the valve assembly that is closer to the load) of the valve assembly in general, the hydraulic fluid is led to the low-pressure fluid tank bypassing the hydraulic pump/motor. In this case, high hydraulic resistances are avoided in order to achieve an appropriate velocity of the relief of the load, for example of the lowering of the weight.

In such a system, it may be provided that the valve system and, in particular, a first valve subsystem comprises a solenoid drivable two-way valve. Such a solenoid valve is easily controllable and may fulfill the function of the first valve subsystem. An electrically controllable solenoid may be used to switch fluid channels.

It may also be provided in such a hydraulic system that the second valve subassembly comprises one or more pressure-controlled valves and in particular comprises exclusively pressure-controlled valves.

The second valve subassembly may comprise one or more hydraulically controlled valves. For example, it is conceivable that the valves of the second valve subassembly are controlled exclusively by the hydraulic pressure on the load side of the second valve subassembly.

It may further be provided that the valve assembly, in particular the second valve subassembly, comprises a pilot operated valve and a sequence valve both fluidly directly connected to the first valve subsystem.

Both of the mentioned valves may be controlled by hydraulic pressure values at their input or exit channels. These valves shall be described in further detail below.

It may further be provided that a first relief channel directly fluidly connects the valve assembly, in particular, the second valve subassembly, with the hydraulic pump/motor.

A further implementation of the invention may provide that a second relief channel fluidly connects the valve assembly, in particular, the second valve subassembly, with a flow control valve which is directly connected to the low-pressure fluid tank such that the hydraulic fluid is passing from the second valve subassembly through the flow control valve to the low-pressure fluid tank.

The flow control valve allows changing a flow resistance depending on the fluid pressure on the load side of the flow control valve (i.e., the side of the flow control valve that is closer to the load) and thereby, the velocity of the flow of the hydraulic fluid may be controlled. This way, in the example of a fork lifter, the speed of the lowering of the weight may be controlled.

It may further be provided that the first relief channel is passing through the hydraulic pump/motor to the low-pressure fluid tank.

Further, it can be provided that the first relief channel between the hydraulic pump/motor and the second valve subassembly is fluidly connected to the low-pressure fluid tank by a safety relief valve.

Thereby, a safety element is provided in order to prevent the hydraulic fluid pressure between the hydraulic pump/motor and the load to exceed a critical value. This is particularly important if the first relief channel is at least partially used in the working phase as a delivery channel in order to transport hydraulic fluid from the hydraulic pump/motor to the load with high pressure.

It may therefore be further provided that the hydraulic pump/motor is fluidly connected with the hydraulic load through a delivery channel which is passing through the first valve subassembly and bypassing the second valve subassembly.

Thereby, the hydraulic pump/motor may easily be fluidly connected with the hydraulic load by switching the first subassembly and this connection may as well easily be closed by the first valve subassembly. The fluid channel connecting the hydraulic pump/motor with the hydraulic load through the first valve subassembly may partially be identical with the first relief channel, as mentioned above.

Based on some examples of implementation, the invention will be shown in figures of a drawing and will be explained below with reference to the figures.

BRIEF DESCRIPTION OF THE FIGURES

FIGS. 1-3 are shown approximately to scale.

DETAILED DESCRIPTION

Figure 1:
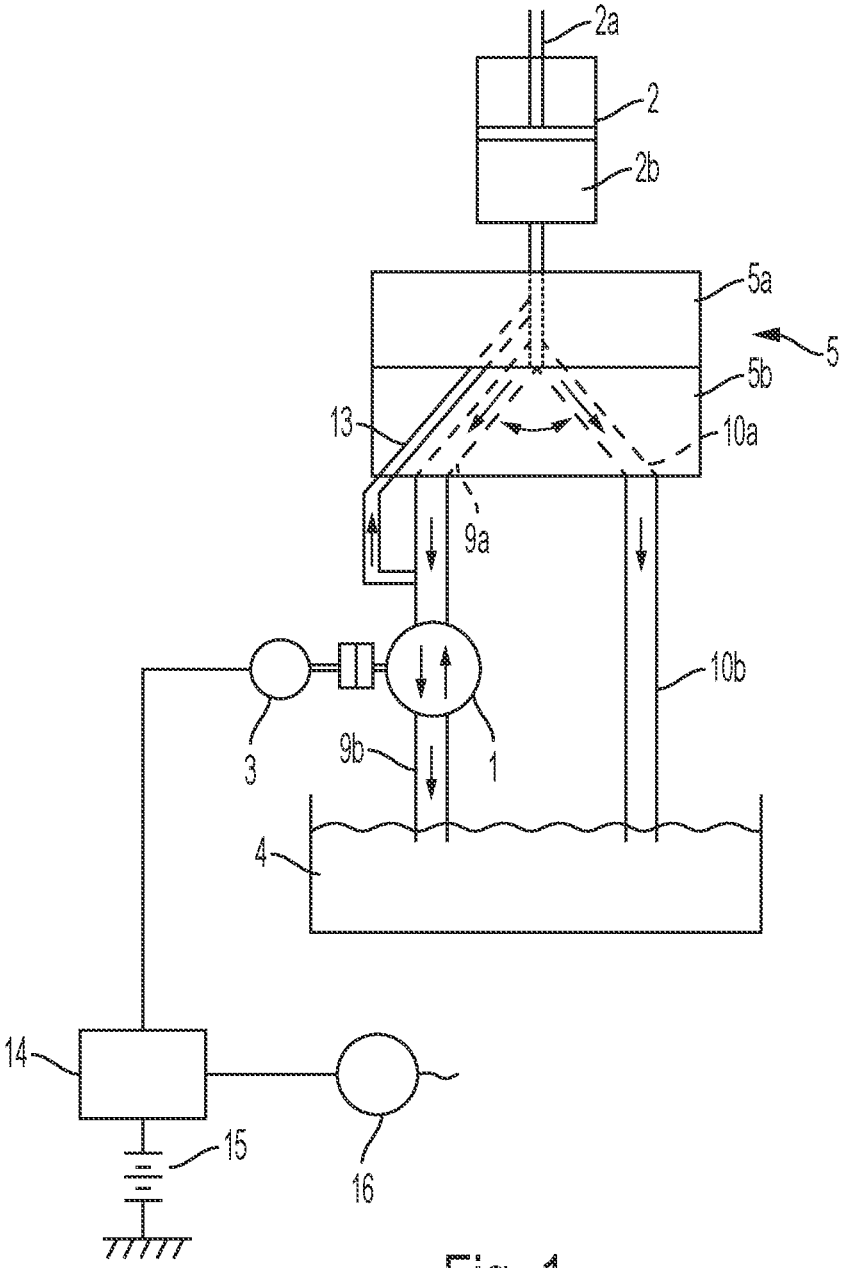
FIG. 1 shows a hydraulic system with a recovery system, wherein the valve assembly is only functionally represented.

FIG. 1 schematically shows a hydraulic load 2 with a piston 2*a* in a cylinder 2*b* which may be actuated by a pressurized hydraulic or work fluid. It is understood that in alternative embodiments the hydraulic load 2 may comprise a hydraulic motor, for example. For actuating the load 2, a hydraulic pump/motor 1 may generate high-pressurized hydraulic fluid which is delivered to the load 2 through a delivery channel 13 and partially through a relief channel 9*b*. The hydraulic pump/motor 1 is fluidly connected to the load 2 through the delivery channel 13. The delivery of pressurized hydraulic fluid from the pump/motor 1 to the load 2 is controlled by a first valve subassembly 5*a* of a valve assembly 5. The delivery channel 13 may bypass a second valve subassembly 5*b*, which is explained in more detail below. When the pump/motor 1 delivers pressurized hydraulic fluid to the load 2, the load 2 is actuated. For example, in a fork lifter the load 2 may be used to lift a weight. When the weight has been lifted, the first valve subassembly 5*a* may be used to fluidly disconnect load 2 from the pump/motor 1 and the weight may be held in the same position until a relief channel 9*b*, 10*b* is opened and the pressurized work fluid may flow from the load 2 through the relief channels to a low-pressure fluid tank 4.

The first valve subassembly 5*a* is fluidly connected with the second valve subassembly 5*b*. The second valve subassembly 5*b* has one or more hydraulic valves which are configured such that a first fluid exit 9*a* of the second valve subassembly 5*b* is opened if or when the pressure value on the load side of the second valve subassembly 5*b* is above a threshold value p*. In this case, the second exit channel 10*a* is closed at the same time.

The hydraulic fluid then flows through a first relief channel 9*b*, which may, in a part of its length, be identical to the delivery channel 13, to the hydraulic pump/motor 1 and further to the low-pressure fluid tank 4, thereby driving the hydraulic pump/motor 1. The hydraulic pump/motor 1 is mechanically coupled to the electrical machine 3 which may in this case act as a generator and generate electric energy. The electric energy may then be fed into a converter 14. The converter 14 may convert the electric energy to DC electric energy, for example, and may feed it into an energy storage device such as a battery 15.

The converter 14 may at the same time act as the control and energy source for a second electric motor 16. For example, the second electric motor 16 may be used to propel a vehicle comprising the hydraulic system, such as a fork lifter. This way, the battery 15 and the converter 14 may be used for control and as an energy source for both electric machines 3, 16. The second electric motor 16 may in a braking phase also act as a generator and feed energy into the battery 15.

If or when the pressure value at the load side of the second valve subassembly 5*b* is below the threshold p*, the first exit channel 9*a* is closed and the second exit channel 10*a* is opened such that the hydraulic fluid may be delivered directly from the second valve subassembly 5*b* through a second relief channel 10*b* to the fluid tank 4.

Using the modes of operation illustrated in FIG. 1, it is possible to guarantee that hydraulic fluid may flow from the load 2 to the low-pressure tank 4 in an appropriate time with an appropriate speed and that at the same time, if or when the pressure at the load 2 is sufficient, the hydraulic fluid may pass through the hydraulic pump/motor 1 and drive the hydraulic pump/motor 1. The hydraulic pump/motor may then drive a generator in order to recover energy and convert it into electric energy that may be stored in an energy storage such as an electric battery.

Figure 2:
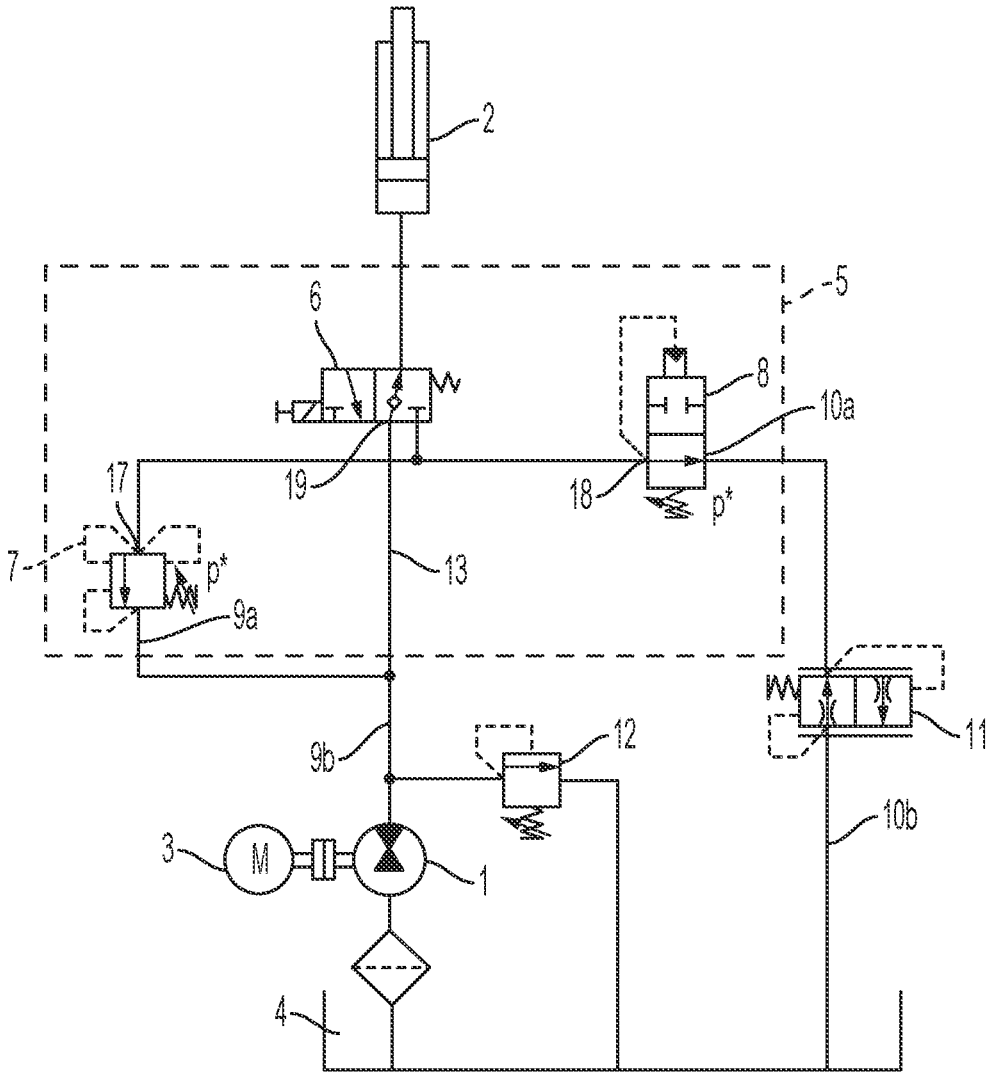
FIG. 2 shows a first concrete implementation of the hydraulic system.

FIG. 2 shows a further embodiment of the hydraulic system explained with respect to FIG. 1. In the embodiment depicted in FIG. 2 the valve assembly 5 comprises a first valve assembly comprised of a solenoid-actuated valve 6 which is driven by an electric signal and which selectively fluidly connects the hydraulic load 2 either with the hydraulic pump/motor 1 or the second valve subassembly which comprises with the valves 7 and 8. The valve 7 is a sequence valve which fluidly connects its entrance channel 17 to its exit channel 9*a* if or when the pressure at its entrance channel 17 is higher than p*. In this case, the valve 7 opens so that hydraulic fluid may pass through the valve 7 to the hydraulic pump/motor 1.

The valve 7 is hydraulically controlled and driven by the pressure at its entrance channel 17. The second valve subassembly further comprises a pilot-operated valve 8 which opens if or when the pressure at its entrance channel 18 is lower than the pressure p*. In this case, the valve 8 allows hydraulic fluid to pass through its exit channel 10*a* and through the second relief channel 10*b* to the low-pressure fluid tank 4. If or when or as soon as the pressure at the entrance channel 18 is above p*, the valve 8 closes. Valve 8, too, is controlled and operated using hydraulic pressure.

The exit channel 10*a* of the valve 8 is fluidly connected with the second relief channel 10*b*, which passes through a flow control valve 11. The flow control valve 11 is controlled by hydraulic pressure and compensates pressure variations and changes in order to guarantee a constant fluid flow.

Figure 3:
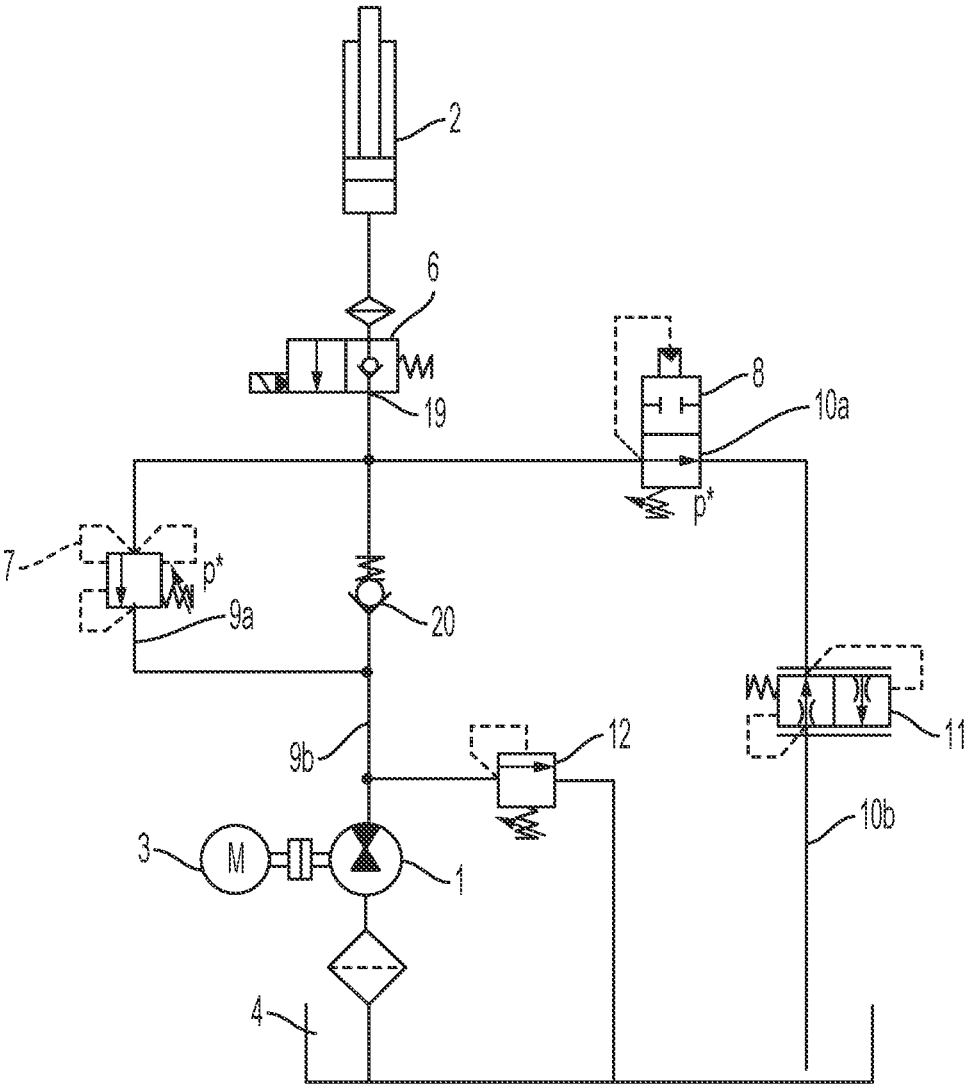
FIG. 3 shows a second implementation of the hydraulic system.

The hydraulic pump/motor 1 is fluidly connected with the second valve subassembly 7, 8 via the first relief channel 9*b*. The first relief channel 9*b* is partially identical with the delivery channel 13 which is used to deliver high-pressurized fluid from the hydraulic pump/motor 1 to the load 2. The delivery channel 13 passes through the solenoid-actuated valve 6. The delivery channel or the solenoid-actuated valve 6 contains a check valve 19, 20 (FIG. 3). The check valve 19, 20 is configured to allow pressurized fluid to be delivered to the hydraulic load 2 through the check valve 19, 20, and to block the flow of hydraulic fluid from the load 2 towards the hydraulic pump/motor 1.

The sequence valve 7 and the pilot-operated valve 8 are fluidly connected to one another at their entrance channels 17, 18. The valves 7, 8 and are further connected to a fluid port or exit channel of the solenoid-actuated valve 6. The exit channel 9*a* of the sequence valve 7 is fluidly connected with the hydraulic pump/motor 1 and with the safety relief valve 12. The exit channel 10*a* of the pilot-operated valve 8 is fluidly connected with the flow control valve 11. The hydraulic load 2 is fluidly connected with an entrance channel of the solenoid-actuated valve 6.

FIG. 3 shows a variation of the embodiment depicted in FIG. 2.

In the embodiment shown in FIG. 3, the exit channel 19 of the solenoid-actuated valve 6 of first valve subassembly is fluidly connected or directly fluidly connected with the entrance channels 17, 18 of the sequence valve 7 and the pilot-operated valve 8 of second valve subassembly. The exit channel 19 is further fluidly connected with to hydraulic pump/motor 1 through a check valve 20. The check valve 20 is configured to allow hydraulic fluid to flow through the check valve 20 from the hydraulic pump/motor 1 towards the hydraulic load 2, and blocks the flow of hydraulic through the check valve 20 from the hydraulic load 2 towards the hydraulic pump/motor 1. If or when the load 2 is relieved by opening the valve 6, hydraulic fluid under pressure may flow from the load 2 to the valves 7, 8 at the same time. The fluid path toward the hydraulic pump/motor 1 is blocked by the check valves 19, 20. The valves 7, 8 open according to the pressure valve regime described above so that the pressurized fluid from the load 2 either flows through the hydraulic pump/motor 1 if or when the pressure is high enough to exceed the value p*, or it flows through the valve 8 and the flow control valve 11 directly to the low-pressure fluid tank 4, thereby bypassing the hydraulic pump/motor 1.

The presently proposed hydraulic system may be used to recover hydraulic or hydrostatic energy from or via a hydraulic load, and to convert it to electric energy which may subsequently be stored in a storage device such as a battery. At the same time, it can be guaranteed that the pressure and/or speed of hydraulic fluid flowing from the hydraulic load to the low-pressure fluid tank is sufficient to allow the load to be relieved and the energy to be recovered fast enough, such as within a predetermined amount of time. For example, in a fork lifter, it can be guaranteed that the fork is lowered fast enough. The embodiments disclosed herein require few control means. The control means used are mostly based on hydraulically driven controls.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A hydraulic system, comprising:
- a hydraulic pump/motor;
- a hydraulic load;
- an electric machine configured to work as an electric generator and mechanically coupled with the hydraulic pump/motor;
- a low-pressure fluid tank;
- a delivery passage connecting the hydraulic pump/motor to the hydraulic load;
- a first valve positioned along a branch bypassing part of the delivery passage, the first valve connecting the hydraulic load with the hydraulic pump/motor when pressure at the hydraulic load is above a threshold pressure;
- an exit passage connecting the hydraulic load to the low-pressure fluid tank and bypassing the hydraulic pump/motor; and
- a second valve positioned along the exit passage, the second valve connecting the hydraulic load with the low-pressure fluid tank when the pressure at the hydraulic load is below the threshold pressure, wherein the second valve is a pilot valve.

2. The hydraulic system according to claim 1, further comprising a solenoid drivable 2-way valve which, in a first position, connects the delivery passage and the hydraulic load and, in a second position, connects the exit passage and the branch bypassing part of the delivery passage to the hydraulic load.

3. The hydraulic system according to claim 1, wherein the first valve is a sequence valve.

4. The hydraulic system according to claim 1, further comprising a safety relief valve and a safety relief passage connected to the delivery passage.

5. The hydraulic system of claim 1, wherein the bypass branch, the delivery passage, and the exit passage meet at a node and the node is connected to the hydraulic load, and
- further comprising a two-position valve connecting the node and the hydraulic load, a first position of the two-position valve flowing fluid in a supply direction, and a second position of the two-position valve flowing fluid in a regeneration direction, and
- a check valve positioned along the delivery passage.

6. A hydraulic system, comprising:
- a hydraulic pump/motor delivering fluid in a supply direction and receiving fluid in a regeneration direction;
- a hydraulic load;
- an electric machine mechanically coupled with the hydraulic pump/motor;
- a low-pressure fluid tank;
- a delivery passage connecting the hydraulic pump/motor to the hydraulic load;
- a bypass branch bypassing part of the delivery passage;
- a first valve positioned along the bypass branch, the first valve comprising an open position which flows fluid in the regeneration direction and a closed position which prevents flow, and the first valve moving to the open position when a pressure from the hydraulic load is above a pressure threshold, wherein the first valve is a sequence valve;
- an exit passage connecting the hydraulic load to the low-pressure fluid tank and bypassing the hydraulic pump/motor;
- a second valve positioned along the exit passage, the second valve opening to flow fluid to the low-pressure fluid tank when the pressure from the hydraulic load is below the pressure threshold; and
- a third valve preventing flow in the regeneration direction within a portion of the delivery passage.

7. The hydraulic system of claim 6, wherein the third valve is a solenoid drivable 2-way valve which, in a first position, connects the delivery passage and the hydraulic load and, in a second position, connects the exit passage and the bypass branch to the hydraulic load.

8. The hydraulic system of claim 6, wherein the second valve is a pilot valve.

9. The hydraulic system of claim 6, wherein the third valve is a check valve positioned along the delivery passage.

10. The hydraulic system of claim 9, wherein the bypass branch, the delivery passage, and the exit passage meet at a node and the node is connected to the hydraulic load.

11. The hydraulic system of claim 10, wherein a fourth valve connects the node and the hydraulic load, and wherein the fourth valve is a two-position valve which, in a first position, flows fluid in the supply direction and, in a second position, flows fluid in the regeneration direction.

12. A hydraulic system, comprising:
- a hydraulic pump/motor delivering fluid in a supply direction and receiving fluid in a regeneration direction;
- a hydraulic load;
- an electric machine mechanically coupled with the hydraulic pump/motor;
- a low-pressure fluid tank;
- a delivery passage connecting the hydraulic pump/motor to the hydraulic load;
- a bypass branch bypassing part of the delivery passage;

a first valve positioned along the bypass branch, the first valve comprising an open position which flows fluid in the regeneration direction and a closed position which prevents flow, and the first valve moving to the open position when a pressure from the hydraulic load is above a pressure threshold;

an exit passage connecting the hydraulic load to the low-pressure fluid tank and bypassing the hydraulic pump/motor;

a second valve positioned along the exit passage, the second valve opening to flow fluid to the low-pressure fluid tank when the pressure from the hydraulic load is below the pressure threshold; and a 2-way valve which, in a first position, connects the delivery passage and the hydraulic load and, in a second position, connects the exit passage and the bypass branch to the hydraulic load.

* * * * *